US007160002B2

(12) United States Patent
Simon

(10) Patent No.: US 7,160,002 B2
(45) Date of Patent: Jan. 9, 2007

(54) SEGMENTED REFLECTOR SYSTEMS AND COMBINED REFLECTOR AND REFRACTOR SYSTEMS

(76) Inventor: Jerome H. Simon, 70 Summer St., Newton Centre, MA (US) 02459

( * ) Notice: Subject to any disclaimer, the term of this patent is extended or adjusted under 35 U.S.C. 154(b) by 32 days.

(21) Appl. No.: 10/601,973

(22) Filed: Jun. 20, 2003

(65) Prior Publication Data

US 2004/0080945 A1 Apr. 29, 2004

Related U.S. Application Data

(60) Provisional application No. 60/390,237, filed on Jun. 20, 2002.

(51) Int. Cl.
*F21V 7/00* (2006.01)

(52) U.S. Cl. ..... 362/299; 362/298; 362/347; 362/361

(58) Field of Classification Search ..... 362/297–299, 362/301, 302, 304, 308, 309, 311, 346, 347, 362/326, 327, 350, 453, 333, 334, 359–361; 359/850–853

See application file for complete search history.

(56) References Cited

U.S. PATENT DOCUMENTS

| | | | | |
|---|---|---|---|---|
| 1,900,436 | A | 3/1933 | Dourgnon | |
| 2,344,221 | A | 3/1944 | Trautner | |
| 2,359,151 | A * | 9/1944 | Pennow | 362/267 |
| 2,454,332 | A | 11/1948 | Mitchell et al. | |
| 3,739,169 | A | 6/1973 | Weinreich | |
| 4,159,511 | A * | 6/1979 | Dejonc | 362/299 |
| 4,264,948 | A * | 4/1981 | Cherouge | 362/311 |
| 4,962,450 | A | 10/1990 | Reshetin | |
| 4,969,074 | A * | 11/1990 | Davis et al. | 362/329 |
| 4,974,137 | A * | 11/1990 | Evans et al. | 362/300 |
| 5,331,530 | A * | 7/1994 | Scholz | 362/293 |
| 5,897,201 | A | 4/1999 | Simon | |
| 5,915,823 | A | 6/1999 | Simon | |
| 6,027,231 | A * | 2/2000 | Fouke | 362/309 |
| 6,354,725 | B1 | 3/2002 | Simon | |
| 6,361,191 | B1 | 3/2002 | Simon | |
| 6,502,964 | B1 | 1/2003 | Simon | |
| 6,536,921 | B1 | 3/2003 | Simon | |
| 6,540,382 | B1 | 4/2003 | Simon | |
| 6,572,234 | B1 * | 6/2003 | Maier et al. | 362/20 |
| 6,616,305 | B1 | 9/2003 | Simon | |

* cited by examiner

*Primary Examiner*—Ali Alavi
*Assistant Examiner*—Hargobind S. Sawhney
(74) *Attorney, Agent, or Firm*—Burns & Levinson LLP; Harvey Kaye; Jerry Cohen

(57) ABSTRACT

An optical assembly for architectural illumination having a quasi point source surrounded by a collimating ring lens designed to radially project collimated beams. A segmented off axis parabolic reflector to collect and reflect light (not gathered by the collimating ring lens) as collimated beams and a segmented ring reflector, the segments of which are arranged to gather beams from both the collimating ring lens and the off axis reflector and then direct them in substantially the same direction.

28 Claims, 6 Drawing Sheets

P-27

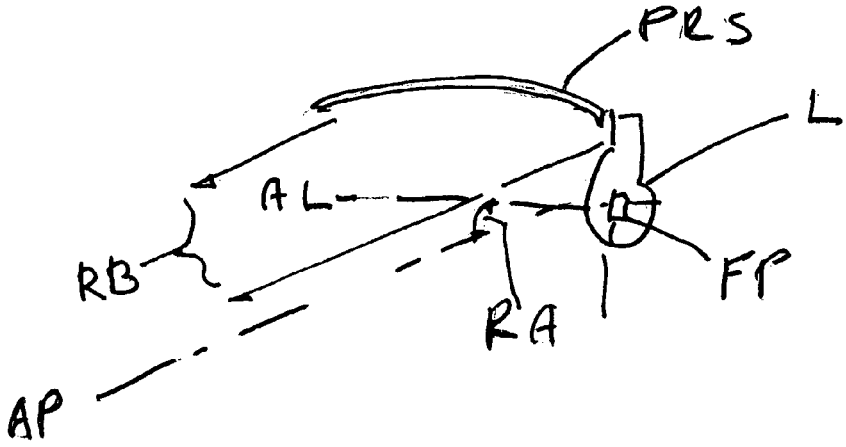
FIG 1A
FIG 7
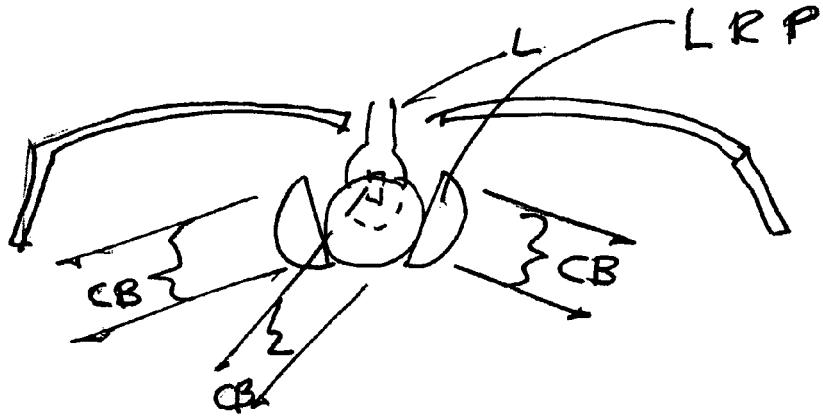

SEGMENTED REFLECTOR SYSTEMS AND COMBINED REFLECTOR AND REFRACTOR SYSTEMS

CROSS-REFERENCE TO RELATED APPLICATIONS

This application is related to and claims the benefit of Provisional Application Ser. No. 60/390,237 filed Jun. 20, 2002, the content of which is hereby included herein by reference.

FIELD OF INVENTION

The present invention relates generally to the lighting field, and, more particularly, to creating fixtures that provide broad, evenly distributed illumination from quasi point source lamps.

SUMMARY OF INVENTION

It is an object of the present invention to provide efficient highly directable light for broad evenly distributed illumination over various architectural surfaces.

It is another object of the present invention to provide sharp light cutoff from the luminaire as to decrease glare.

It is yet another object of the present invention to shape surface illumination patterns.

It is yet a further object of the present invention to project a majority of the flux provided by a quasi point source lamp in a unified direction.

It is yet another object of the present invention to produce a compact optical system to reduce luminaire depth.

These and other objects of the present invention are accomplished as described below A quasi point source located on an optical axis having a radially segmented reflecting disk substantially parabolic or ellipsoidal in section the focal point of which is disposed along the optical axis and corresponding to the quasi point source. The radiating disk of light radiating from the segmented reflector disk is sectionally perpendicular on an obtuse angle to the optical axis and is segmented into individual collimated beams as reflected off transverse concave surfaces on the radial sections.

Further surrounding the quasi point source is a segmented reflector ring which is substantially concentric to the segmented reflector disk and is positioned along the optical axis as to receive the reflected beams from the segments of the reflector disk and also direct light from the quasi point source. The segments of the reflector ring are disposed in a manner to alternately reflect beams from the reflector disk and rays from the quasi point source and are tilted in respect to the optical axis so as to direct both the individual beams and the direct rays substantially towards the same area to be illuminated.

These and other objects, features and advantages will be apparent from the following detailed description of preferred embodiments taken in conjunction with the accompanying drawings in which:

BRIEF DESCRIPTION OF DRAWINGS

FIG. 1A is a sectional diagram illustrating the cross-sectional view of reflector disc RD in FIGS. 1, 2, 3, 4, 5, and 6.

FIG. 7 illustrates a variation to the optical system of FIG. 6 with a segmentation of the ring lens component.

DETAILED DESCRIPTION OF THE DRAWINGS

Figure 1:
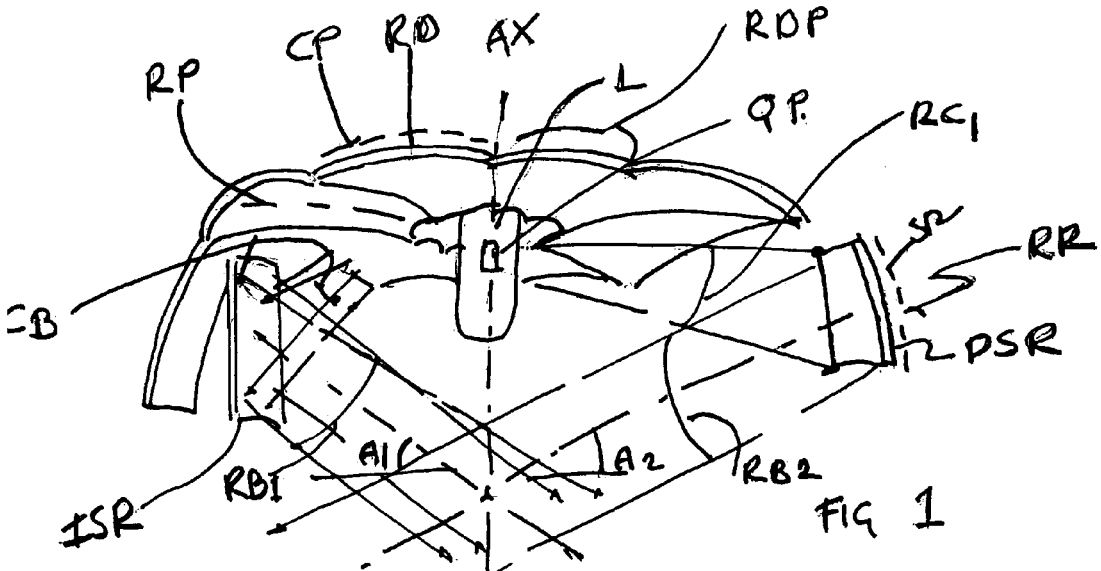
FIG. 1 is a cross-sectional, three dimensional diagram of an optical system designed to collect and distribute light in a broad even pattern.

FIG. 1 is a cross-sectional, three-dimensional diagram of an optical system designed to collect and distribute light in a broad even pattern. The system provides light in a direction as reflected, and through an area which will be referred to as an aperture. The optical system represented is composed of a central lamp L having a quasi point source QP, which can be a filament or arc. A reflector disk RD is disposed along light axis AX. RD is radially segmented into pie-shaped segments RDP. The number of RDP segments may vary and may be unequal in respect to the central angle of RD. RD has a compound surface, the radial section of which (represented by dotted line RP) is substantially parabolic; the focal point of the parabola aligns substantially at QP. The transverse section of RDP is concave (represented by dotted line CP), the acuteness of concavity increasing as the transverse section of RDP increases as the distance increases from AX. This is explained further in connection with FIG. 3. The resulting compound surface of RDP results in beam CB, which is focused onto a segment, ISR, of reflecting ring RR.

Reflecting ring RR is substantially concentric to RD, having AX as its axis. RR is comprised of alternate reflector segments DSR and ISR. ISR receives and redirects CB (which is focused onto ISR) as beam RB1. RB1 is a representation of a conical beam that would results from having multiple reflector segments ISR. Reflector segments DSR has a concave cross-section (represented by dotted line SR), that collects and projects radiant light RC1 from QP as beam RB2. Since ISR and DSR are canted at different angles in relation to AX, the central beam angle of A1 of RB1 and A2 of RB2 are substantially equal. RB2 represents one of the multiple reflected beams emanating from multiple reflecting segments of DSR.

The conical beams of RB1 and RB2 form a substantially homogenous conical beam.

FIG. 1A is a sectional diagram illustrating the cross-sectional view of reflector disk RD in FIGS. 1, 2, 3, 4, 5, and 6. The central axis AP of the parabola PRS may be rotated around the focal point FP, increasing or decreasing angle RA in respect to the center of radiation AL of L, therefore changing the cant of the conical beam RB. RA maybe 0°.

Figure 2:
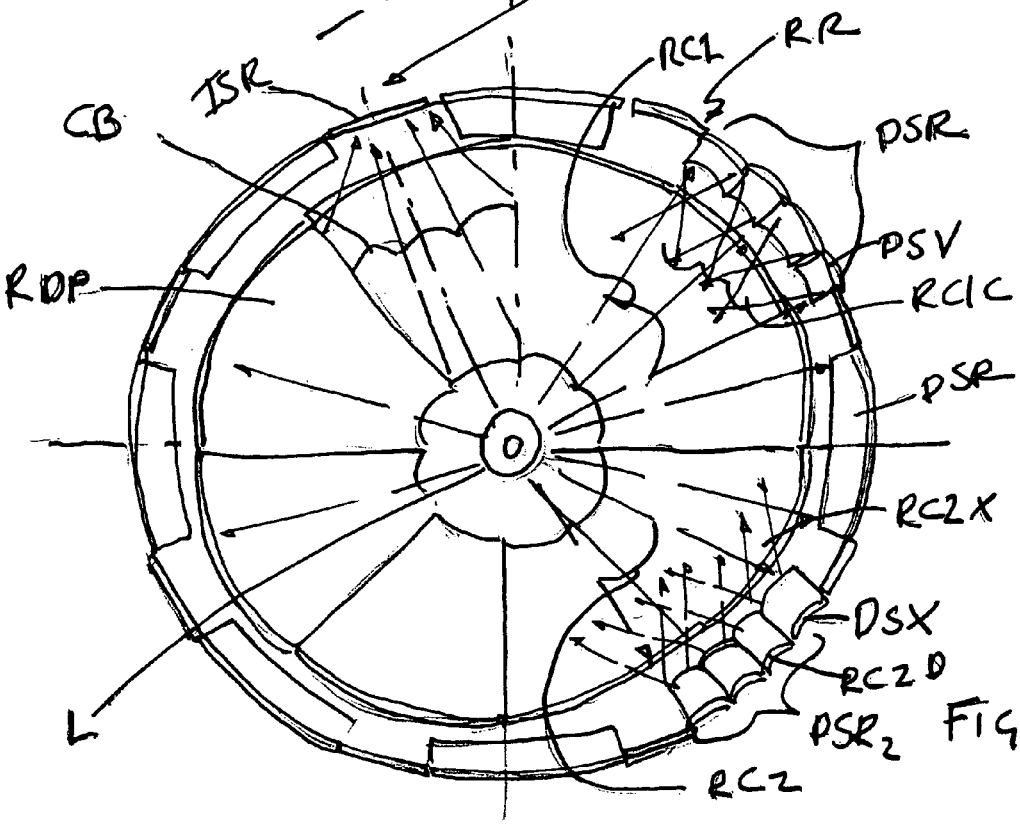
FIG. 2 is a plan view of FIG. 1.

FIG. 2 is a plan view of FIG. 1, illustrating rays CB reflected from a common reflector segment RDP onto a reflector segment ISR of RR; direct rays RC1 (radiating from lamp L) onto a reflector segment DSR of RR; and direct rays RC2 (radiating from lamp L) onto a reflector segment DSX of RR. DSR is comprised of cylindrically concave surfaces DSU, which reflect RC1 as converging then diverging rays RC1C. DSR2 is comprised of cylindrically convex surfaces DSX, which reflect RC2 as diverging rays RC2X.

Figure 3:
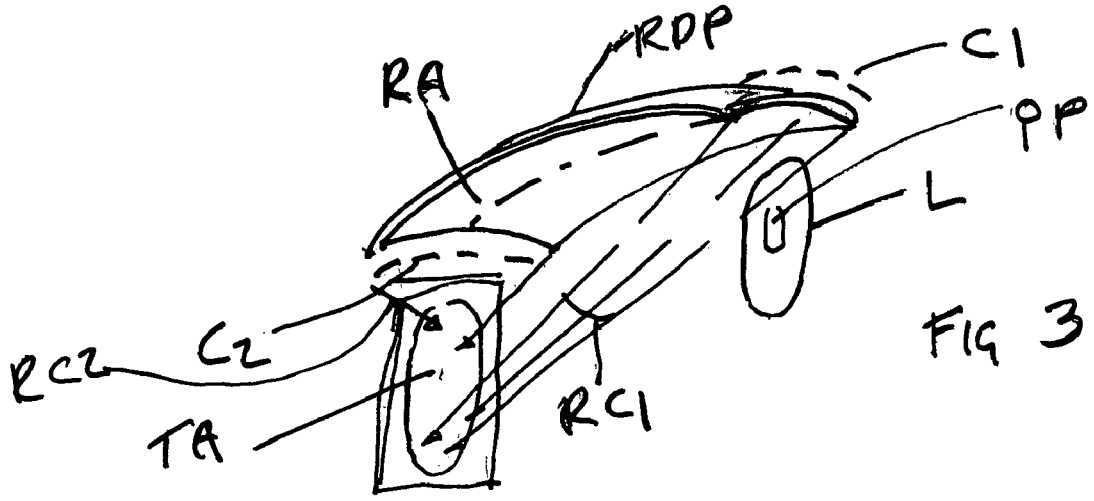
FIG. 3 is a diagram that further illustrates the function of a portion of the reflector system that is illustrated in FIG. 1.

FIG. 3 is a diagram that further illustrates the function of a single RDP segment of reflector disk (RD of FIG. 1). The radial axis RA of RDP is substantially parabolic, controlling the vertical height of light target area TA. The radius of the transverse curvature of RDP decreases as the distance from QP of lamp L increases; the radius of C1 is greater than the radius C2. And therefore, the focal distance of reflected beam RC1 is longer than the focal distance of reflected beam RC2. As the radius of the transverse curvature decreases, the focal distance of the curvature decreases. Thus, the width of TA is maintained and relatively uniform.

Figure 4:
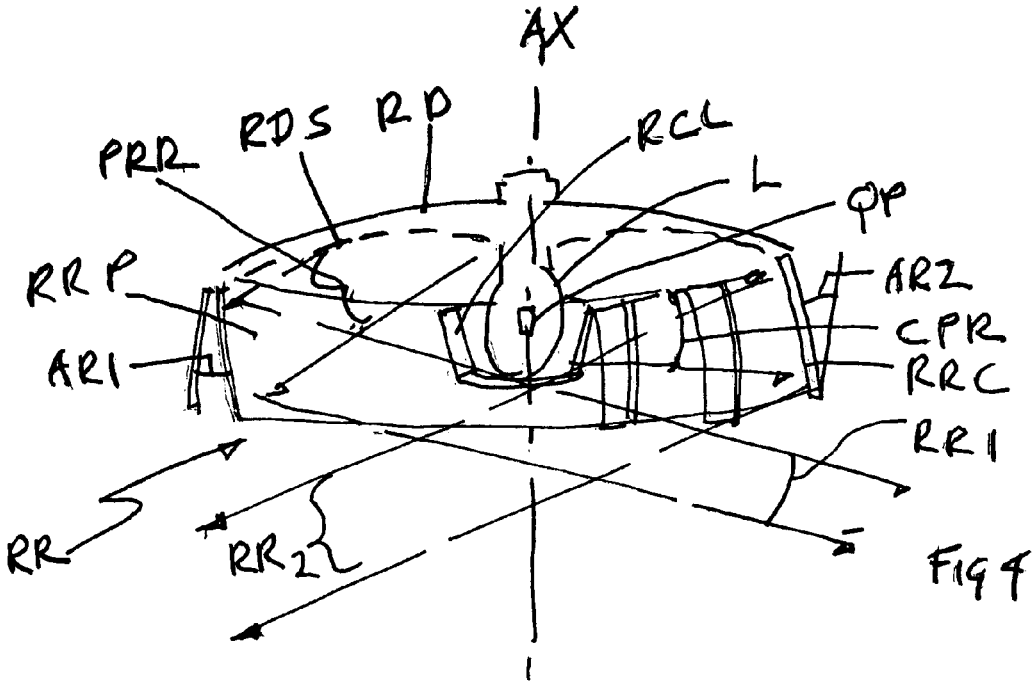
FIG. 4 is a three-dimensional view of a luminaire similar to that described in FIGS. 1 and 1A.

FIG. 4 is a three-dimensional view of a luminaire similar to that of the luminare described in FIGS. 1 and 1A, with the following variations in components: RD is parabolic in cross-section (represented by dotted line RDS), but not radially segmented, and a ring of vertically-oriented cylindrical lenses RCL surround lamp L containing quasi-point source QP. RD reflects and projects radiation from QP onto RR as a canted conical beam PRR. RCL divides radiation from QP forming radial bands of radiation CPR, which are reflected and vertically condensed as rays RR2 by reflector segments RRC of RR. PRR is reflected from reflector segments RRP as rays RR1. CPR and RRP segments are at different angles to each other (represented respectively by angles AR2 and AR1) in respect to lamp axis AX so that RR1 and RR2 may be targeted toward the same area.

Figure 4B:
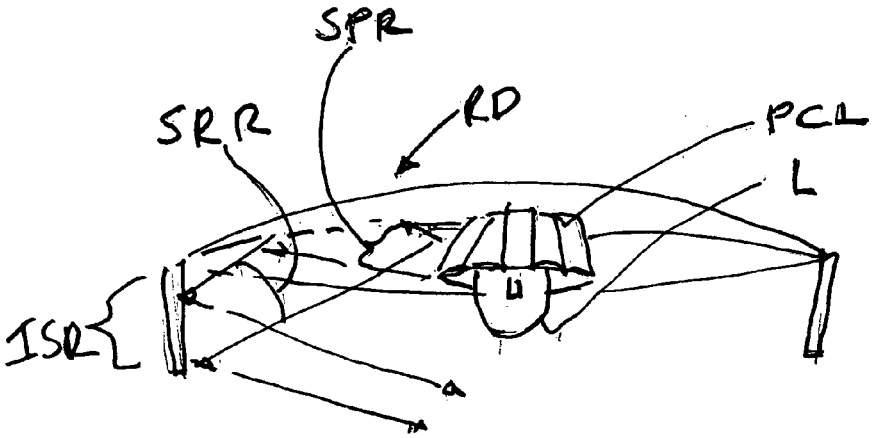
FIG. 4B is a three-dimensional diagram that illustrates an alternative component to that shown in FIG. 1.

FIG. 4B is a three-dimensional cross-sectional diagram that illustrates an alternative to segmenting reflector disk RD (in FIG. 1) in order to create segmented radial beams CB (in FIG. 1).

L is surrounded by substantially vertically or curved cylindrically segmented ring PCL, which divides radiation from L into radial beams SPR, which are further reflected by RD as beams SRR (shaped as RD in FIG. 4) onto ISR (as in FIG. 1).

Figure 5:
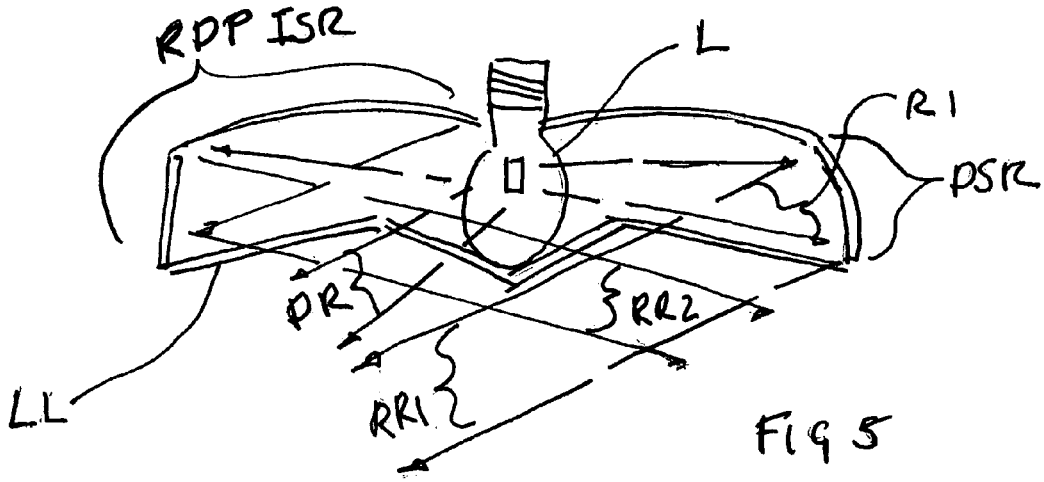
FIG. 5 is a cross-sectional diagram of a luminaire having similar reflective structures as in FIGS. 1, 2, 1A, 3, and 4 with the addition of a lens component.

FIG. 5 is a cross-sectional diagram of a luminaire having similar reflective optical structure, as illustrated in FIGS. 1, 2, 1A, and 3 or FIG. 4, as represented by reflectors RDPISR and DSR surrounding lamp L with the addition of lower lens LL. LL is shaped to allow reflected rays RR1 and RR2 to pass through at angles that are not highly acute (less than 20°) so as to not cause reflection of the beam R1 and therefore decrease the efficiency of beam RR1. The same applies to direct radiation DR from L.

Figure 6:
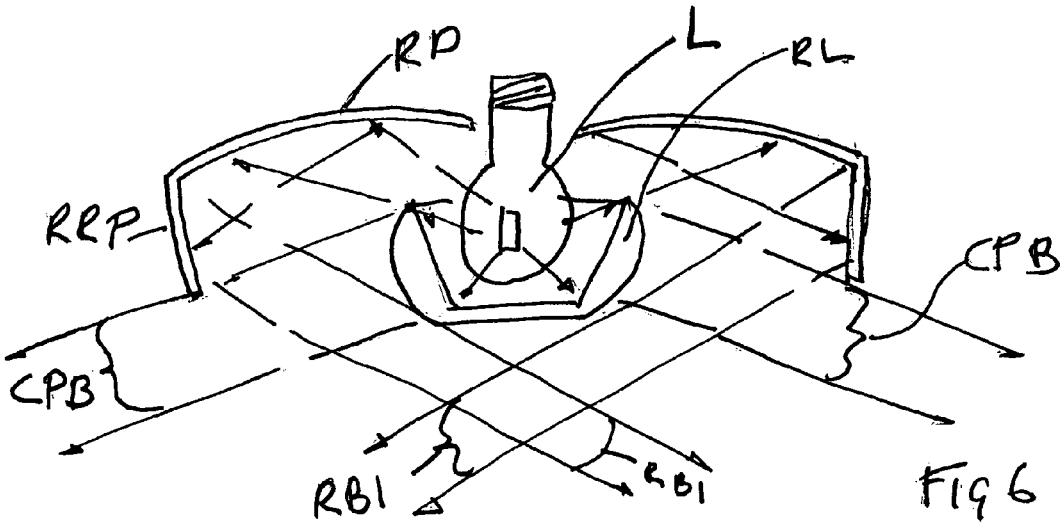
FIG. 6 is a cross-sectional diagram of an optical system similar to that of FIG. 4 with the addition of a ring lens component.

FIG. 6 is a cross-sectional diagram of an optical system comprised of RD and RRP of FIG. 4, with the addition of canted collimating ring lens RL, which gathers radiation from L and projects it as conical beam CPB, the section of which is parallel on at an acute angle to the section of reflected conical beam RB1.

FIG. 7 illustrates a variation of the optical system of FIG. 6, showing ring lens LRP surrounding L, which is segmented into individual lenses that gather radiant light from L and project beams CB.

LRP may be single or double convex lenses, meniscus lenses, fresnel lenses, or lenses that are formed by adding cylindrical surfaces onto the inside or outside of ring collimators. When part of a ring, these lenses (LRP) may occupy the entire ring or be spaces forming alternate areas on the ring that perform other optical functions. This is further illustrated in FIGS. 8 and 8A by combining reflector optics shown in FIGS. 1, 1A, 2, 3, 4, 4B, 5, 6, and 7, with the refracting optics in FIGS. 7, 8, and 8A substantially square or rectangular, so that patterns of light can be achieved.

Figure 8:
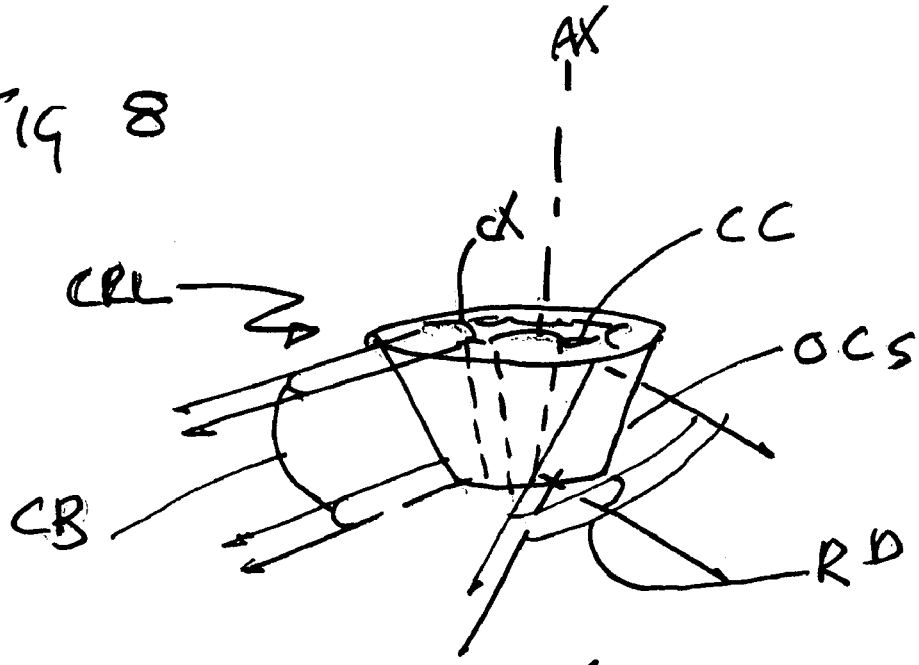
FIG. 8 is a three-dimensional diagram of a variation to the lens illustrated in FIG. 6.

FIG. 8 is a three-dimensional diagram of a conical ring lens CRL having convex surfaces CX alternating with areas of inner and outer concentricity CV that have no lensing power. CX projects radially collimated beams CB while CC allows light RD to leave on the radius of the light source (not shown). Power may be given to the outside surface OCS, which would control the degree of collimation in respect to the central axis AX of CRL.

Figure 8A:
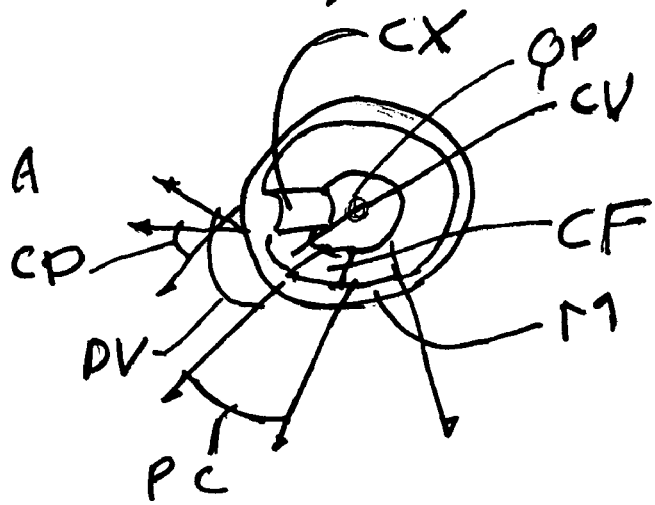
FIG. 8A is a plan view of FIG. 8.

FIG. 8A is a plan view of a lens illustrated in FIG. 8, showing varied surfaces that may be alternated with the inner or outer surface of the lens CX, which is cylindrically convex projecting either converging then diverging beam CD or a collimated beam. CV is cylindrically concave, forming a diverging beam DV. CF is flat, forming a beam PC that is more acute radial rays direct from the light source QP, surface M having no power (the inner and outer surfaces of the ring being concentric) allowing rays from QP to leave on the radii of radiation.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. An optical system of the type having an aperture for light to pass through and designed to collect and project a substantial amount of radiant flux from a quasi point source lamp as a substantially collimated radial beam the optical system comprised of:

a. a quasi point source lamp located on an optical axis;

b. a segmented radial disk located on said optical axis, said radial disk including parabolic or ellipsoidal radial segments having their focal points coinciding with said quasi point source; each of said radial segments being concave in the transverse section; and c. a segmented reflector ring surrounding the quasi point source being disposed along the optical axis with one set of ring segments disposed to collect reflected beams from the segmented radial disk and another set of ring segments disposed to collect, collimate and direct light from the quasi point source, both sets of reflectors being canted in relationship to the optical axis so that both the reflected beams and refracted direct light are projected in substantially the same radial plane away from the luminaire.

2. An optical system as defined in claim 1 wherein a conical lens at least partially covers the aperture of the luminaire.

3. An optical system as defined in claim 1 wherein a canted collimating ring lens is disposed around the optical axis to collimate a radial beam substantially parallel to the reflected beams.

4. An optical system as defined in claim 3 wherein the canted collimating ring lens is comprised of individually collimating segments.

5. An optical system as defined in claim 4 wherein the section of the canted ring lens is plano-convex.

6. An optical system as defined in claim 4 wherein the canted ring lens is double convex in section.

7. An optical system as defined in claim 4 wherein the canted ring lens is Fresnel in section.

8. An optical system as defined in claim 3 wherein the section of the canted ring lens is plano-convex.

9. An optical system as defined in claim 3 wherein the canted ring lens is double convex in section.

10. An optical system as defined in claim 3 wherein the canted ring lens is Fresnel in section.

11. An optical system as defined in claim 1 wherein at least some of the reflective segments of the ring reflectors are convex.

12. An optical system as defined in claim 1 wherein at least some of the ring reflectors segments are concave.

13. An optical system as defined in claim 1 wherein at least some of the ring reflective segments are flat.

14. An optical system designed to collect and project a substantial amount of radiant flux from a quasi point source lamp as a substantially collimated radial beam the optical system comprising:

a. a quasi point source lamp located on an optical axis;

b. a radial disk located on said optical axis, said radia1 disk including parabolic or ellipsoidal radial segments having their focal points coinciding with said quasi point source on said optical axis;

c. a refractive ring including positive cylindrical lenses radially disposed about the optical axis refracting light rays from the quasi point source to the reflection disk;

d. a segmented reflector disk surrounding the quasi point source of which a portion of the segments are disposed to reflect and direct light received from the reflector disk and another portion of the segments disposed to reflect and direct light received from the quasi point source.

15. An optical system as defined in claim 14 wherein the refractive ring includes collimating lens segments.

16. A luminaire designed to distribute light in a broad even pattern and provide sharp cutoff, comprised of an optical system designed to collect and project a substantial amount of light from a quasi-point source lamp, through an aperture, in the form of a canted radial substantially collimated beam the luminaire comprised of:

a quasi-point light source located on an optical axis;

a reflector system at least partially surrounding said light source and said optical axis, said reflector system having surfaces shaped to collect, collimate, and reflect light received directly from the quasi-point light source, said reflector surfaces being disposed at an angle to project a canted radial homogenous beam, through said aperture;

a lens at least partially covering said aperture that is shaped in such a manner as to permit acutely reflected rays of the canted radial beam to pass therethrough and therefore increase the efficiency of the said lens being conical in section luminaire.

17. A luminaire as defined in claim 16 wherein the lens has a curved sectional shape.

18. A luminaire as defined in claim 17 wherein the diameter of the dome is substantially located in the place of the aperture, the curved surfaces of said dome curving inward toward the quasi-point light source.

19. A luminaire as defined in claim 16 wherein the large diameter of the cone is substantially located in the plane of the aperture, the sides of the cone tapered inward toward the quasi-point light source.

20. A luminaire as defined in claim 16 wherein the lens has is comprised of at least two substantially concentric ring sections, an outer ring section having a wide diameter substantially located in the plane of the aperture, the sides of this section either straight or curved in section append inward and cant toward the quasi-point light source, forming a smaller diameter; the inner ring section, having a larger diameter that joins at its circumference with the circumference of the small diameter of the outer ring, have sides in section being curved or straight and append away from and form an enclosure around the quasi-point light source.

21. A luminaire as defined in claim 16 wherein the reflector system is comprised of at least two distinct components, the combined reflection of both components producing a substantially homogenized canted radial beam.

22. A luminaire as defined in claim 21 wherein at least one component is a reflector ring at least partially surrounding the optical axis.

23. A luminaire as defined in claim 21 wherein at least one component is a disk surrounding and perpendicular to or at an obtuse angle to the optical axis.

24. A luminaire as defined in claim 23 wherein a radial beam of light is reflected from the disk onto and further reflected by a reflective ring component.

25. A luminaire as defined in claim 21 wherein at least one reflector component is comprised of sections.

26. A luminaire designed to distribute light in a broad even pattern and provide sharp cutoff comprised of an optical system designed to collect and project a substantial amount of light from a quasi-point light source lamp through an aperture in the form of a canted radial substantially collimated beam comprised of:

a quasi-point light source located on an optical axis;

a reflector system at least partially surrounding said light source and said optical axis, said reflector system having surfaces shaped to collect, collimate and reflect light received directly from the quasi-point light source, said surface being disposed at an angle to project a canted radial homogenized beam through said aperture; and a canted collimating ring lens disposed around the light source and receiving light directly from the light source to collimate a radial beam substantially parallel to the reflected beams from said reflector system.

27. A luminaire as defined in claim 26 wherein rays from the canted collimating ring lens do not impinge on the reflector system.

28. A luminaire as defined in claim 26 wherein the canted collimating ring lens is comprised of individual collimating sections designed to project a pattern such as a square or rectangle.

* * * * *